US009730541B2

(12) United States Patent
Thorpe

(10) Patent No.: US 9,730,541 B2
(45) Date of Patent: Aug. 15, 2017

(54) WINDOW TREATMENT CLOSURE DEVICE AND METHOD

(71) Applicant: Ricky V. Thorpe, Davie, FL (US)

(72) Inventor: Ricky V. Thorpe, Davie, FL (US)

( * ) Notice: Subject to any disclaimer, the term of this patent is extended or adjusted under 35 U.S.C. 154(b) by 115 days.

(21) Appl. No.: 14/598,409

(22) Filed: Jan. 16, 2015

(65) Prior Publication Data

US 2016/0206127 A1 Jul. 21, 2016

(51) Int. Cl.
*A47H 1/10* (2006.01)
*A47H 1/102* (2006.01)
*A47H 1/02* (2006.01)

(52) U.S. Cl.
CPC ..... *A47H 1/102* (2013.01); *A47H 1/02* (2013.01)

(58) Field of Classification Search
USPC ..... 248/261
See application file for complete search history.

(56) References Cited

U.S. PATENT DOCUMENTS 3,616,486 A * 11/1971 Ford et al. ..... A47H 1/04 16/87.2
3,854,517 A * 12/1974 Nakamura ..... E06B 9/50 160/321
4,675,939 A * 6/1987 Fukada ..... A47H 13/01 16/102
5,289,863 A * 3/1994 Schon ..... E06B 9/364 160/168.1 R
6,330,900 B1 * 12/2001 Welfonder ..... E06B 9/36 160/177 V
6,763,953 B1 * 7/2004 Pobee-Mensah .. G11B 33/0422 211/124
6,892,785 B1 * 5/2005 Hung ..... E06B 9/362 160/168.1 V
7,942,184 B2 * 5/2011 Cech ..... E06B 9/36 160/172 V
8,469,078 B2 * 6/2013 Drew ..... E06B 9/06 16/87.4 R
2006/0151131 A1 * 7/2006 Bohlen ..... E06B 9/362 160/177 V
2009/0283225 A1 * 11/2009 Luger ..... A47H 5/0325 160/310
2011/0225774 A1 * 9/2011 Seddon ..... A47H 1/02 16/94 D
2011/0283479 A1 * 11/2011 Peters ..... A47H 1/04 16/87.2
2012/0037324 A1 * 2/2012 Graneto, III ..... A47H 1/04 160/341
2015/0107788 A1 * 4/2015 Mullet ..... A47H 1/02 160/405

* cited by examiner

*Primary Examiner* — Monica Millner
(74) *Attorney, Agent, or Firm* — Johnson & Martin, P.A.; James David Johnson

(57) ABSTRACT

A window treatment device is provided including a main body, secondary body, elongated rod, curtain rod, and grommet. The elongated rod may connect with the main body and/or the secondary body. The grommet may be removably insertable into the main body. The secondary body may be movable about the elongated rod. The main body may at least partially be enclosed by the curtain rod. A method is provided for constructing a window treatment device.

19 Claims, 7 Drawing Sheets

WINDOW TREATMENT CLOSURE DEVICE AND METHOD

FIELD OF THE INVENTION

The present invention relates to a window treatment device. More particularly, the present invention relates to a device usable in a window to extend and retract a closable portion.

BACKGROUND

Window treatments have long been used to decorate and provide functional improvements to windows. Window treatments may be placed on, in, around, or over a window, often with the goal of improving the aesthetics of the window and corresponding room. Window treatments may include window closure devices, such as shutters, blinds, shades, curtains, and draperies that affect the amount of light received by a room from the window.

Window treatments may provide privacy and security by obscuring visibility through a window. For example, shades, blinds, and curtains may block visibility to prevent a passerby from looking into a house.

Window treatments are customarily held near the top of a window and may include a mechanism for installation. However, existing window treatments are difficult to construct and complicate modifying the treatment between permitting visibility and obscuring visibility. Additionally, existing window treatments lack the flexibility needed to install the window treatment in different environments.

What is needed is a window treatment device that is simple to operate and can be flexibly installed in an environment. What is needed is a window treatment device that can be easily constructed and installed by a user.

SUMMARY

The present invention provides a window treatment constructed of various components that can be assembled and/or installed by a user. The window treatment device of the present invention may include a main body, a secondary body, a grommet, a curtain rod, and additional components. The present invention advantageously provides a window treatment device that is simple to operate and can be flexibly installed in an environment. Additionally, the present invention advantageously provides a window treatment device that can be easily constructed and installed by the user.

According to an embodiment of the present invention, a window treatment device is provided including a main body, elongated rod, secondary body, curtain rod, and grommet. The elongated rod is locatable at least partially within the main body. The secondary body is slidably positionable about the elongated rod. The main body is at least partially insertable into the curtain rod. The grommet is attachable to the main body.

In another aspect, the main body may include an upper main body receiver slot to receive the grommet.

In another aspect, the grommet may include a grommet tab insertable into an upper main body retainer clip. The upper main body retainer clip may be insertable into the upper main body receiver slot to attach the grommet.

In another aspect, the curtain rod may include a curtain rod opening extending substantially between a curtain rod front end and a curtain rod rear end of the curtain rod.

In another aspect, at least part of the grommet is at least partially passable through the curtain rod opening.

In another aspect, the main body that is removably attached to the grommet via insertion of the upper main body retainer clip into the upper main body receiver slot is at least partially passable through the curtain rod opening with the grommet.

In another aspect, the main body may include a side main body receiver slot to removably receive a side main body retainer clip.

In another aspect, the main body may include a main body right side and a main body left side. The main body right side may include a right side main body receiver slot. The main body left side may include a left side main body receiver slot. A right side main body retainer clip may be removably insertable into the right side main body receiver slot. A left side main body retainer clip may be removably insertable into the left side main body receiver slot.

In another aspect, the elongated rod may include an elongated rod first end and an elongated rod second end. The main body may include a main body elongated rod receiver slot through which the elongated rod first end of the elongated rod may be at least partially insertable. The secondary body may include a secondary body elongated rod receiver slot through which the elongated rod second end of the elongated rod may be at least partially insertable.

In another aspect, the secondary body may include a secondary body caster hole to receive a caster and connected caster axle.

In another aspect, the secondary body may include a right secondary body caster hole located on a secondary body right side of the secondary body. The secondary body may additionally include a left secondary body caster hole located on a secondary body left side of the secondary body. A right caster may be attached to a right caster axle and may be at least partially insertable into the right secondary body caster hole. A left caster may be attached to a left caster axle and may be at least partially insertable into the left secondary body caster hole.

In another aspect, the elongated rod may be substantially t-shaped.

In another aspect, the main body may include a bottom main body hole. The curtain rod may include a bottom curtain rod hole. The curtain rod may be removably attachable to the main body by inserting an object through the bottom curtain rod hole and at least partially through the bottom main body hole.

According to an embodiment of the present invention, a window treatment device is provided including a main body, a secondary body, an elongated rod, a curtain rod, and a grommet. The main body may additionally include an upper main body receiver slot, a right side main body receiver slot, a left side main body receiver slot, and a main body elongated rod receiver slot. The right side main body receiver slot may be located on a main body right side of the main body to receive a right side main body retainer clip. A left side main body receiver slot may be located on a main body left side of the main body to receive a left side main body retainer clip. The elongated rod may be locatable at least partially within the main body via the main body elongated rod receiver slot. The main body may be at least partially insertable into the curtain rod. The curtain rod may further include a curtain rod front end, a curtain rod rear end, and a curtain rod opening extending substantially between the curtain rod front end and the curtain rod rear end. The grommet may include a grommet tab receivable by the main body via an upper main body retainer clip to removably attach the grommet to the main body. The grommet may be passable at least partially through the curtain rod opening.

The main body may be at least partially passable through the curtain rod such to be at least partially enclosed by the curtain rod.

In another aspect, the window treatment may include a secondary body slidably positionable about the elongated rod. The secondary body may include a secondary body elongated rod receiver slot through which the elongated rod is at least partially insertable.

In another aspect, the secondary body may include a secondary body caster hole to receive a caster and connected caster axle.

In another aspect, the elongated rod may be substantially t-shaped.

According to an embodiment of the present invention, a method is provided for constructing a window treatment device including a main body, an elongated rod, a secondary body, a curtain rod, and a grommet. The method may include locating the elongated rod at least partially within the main body by inserting an elongated rod first end of the elongated rod at least partially into a main body elongated rod receiver slot of the main body. The method may additionally include removably inserting an upper secondary body retainer clip into an upper secondary body receiver slot of the secondary body. The method may further include locating the elongated rod at least partially within the secondary body by inserting an elongated rod second end of the elongated rod at least partially into a secondary body elongated rod receiver slot of the secondary body. The method may include, locating a side main body retainer clip within a side main body receiver slot of the main body. The method may include locating a grommet tab of the grommet at least partially within an upper main body retainer clip. The method may additionally include removably inserting the upper main body retainer clip with the grommet tab within an upper main body receiver slot of the main body. The method may include passing at least part of the main body through a grommet hole of the grommet. Furthermore, the method may include passing at least part of the main body within the curtain rod such that the curtain rod may at least partially enclose the main body. The second body may be movable about the elongated rod.

In another aspect, before the above-recited steps, the method may include installing a caster in the secondary body. Installing the caster may include attaching a caster axle to the caster, and inserting the caster with the caster axle at least partially into a secondary body caster hole.

In another aspect, the method may include inserting an object through a bottom curtain rod hole of the curtain rod and at least partially through a bottom main body hole of the main body to removably attach the curtain rod to the main body.

Unless otherwise defined, all technical terms used herein have the same meaning as commonly understood by one of ordinary skill in the art to which this invention belongs. Although methods and materials similar or equivalent to those described herein can be used in the practice or testing of the present invention, suitable methods and materials are described below. All publications, patent applications, patents and other references mentioned herein are incorporated by reference in their entirety. In the case of conflict, the present specification, including definitions will control.

DETAILED DESCRIPTION

Figure 1:
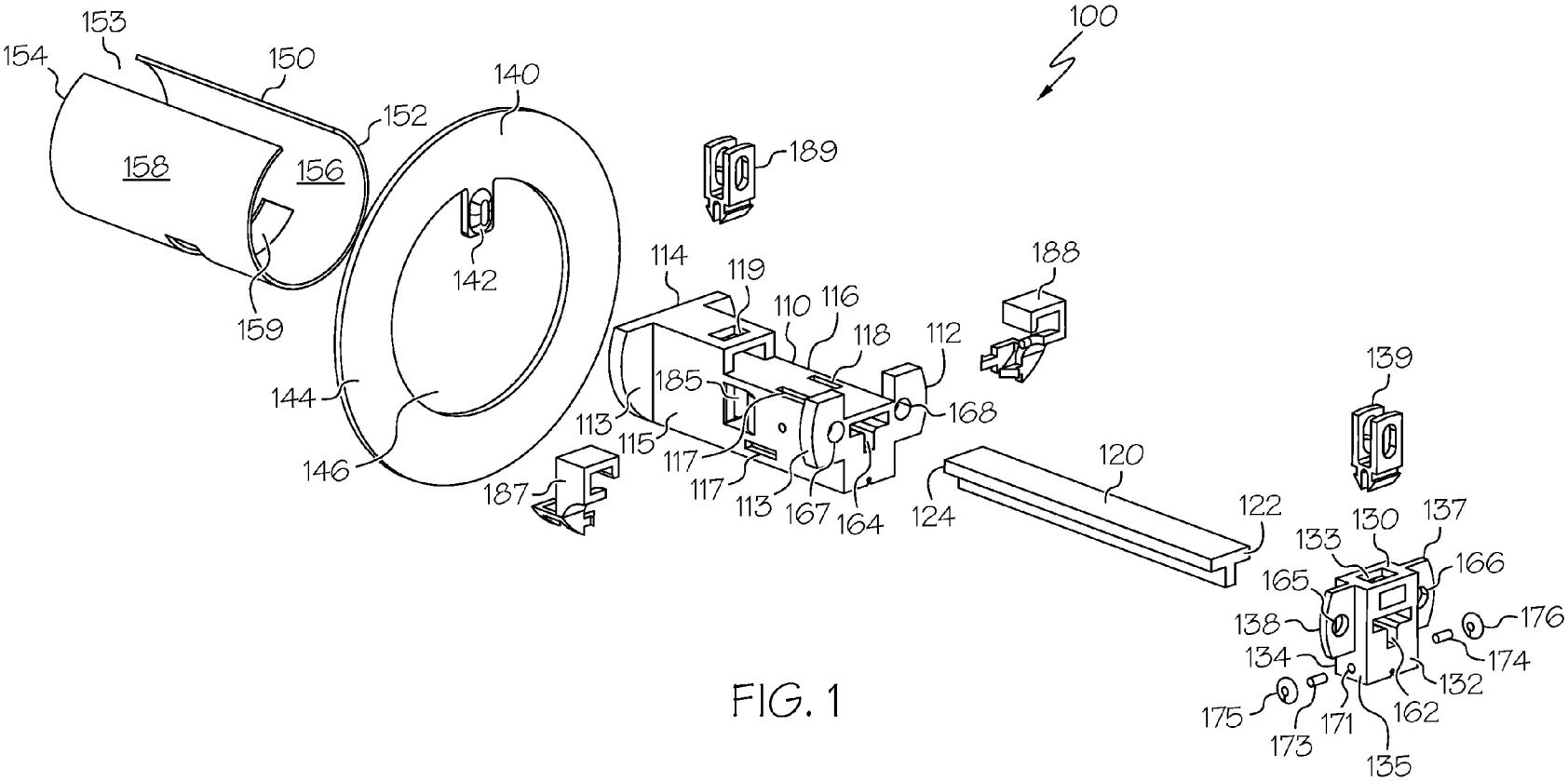
FIG. 1 is a perspective view of a window treatment, according to an embodiment of the present invention.

The present invention is best understood by reference to the detailed drawings and description set forth herein. Embodiments of the invention are discussed below with reference to the drawings; however, those skilled in the art will readily appreciate that the detailed description given herein with respect to these figures is for explanatory purposes as the invention extends beyond these limited embodiments. For example, in light of the teachings of the present invention, those skilled in the art will recognize a multiplicity of alternate and suitable approaches, depending upon the needs of the particular application, to implement the functionality of any given detail described herein beyond the particular implementation choices in the following embodiments described and shown. That is, numerous modifications and variations of the invention may exist that are too numerous to be listed but that all fit within the scope of the invention. Also, singular words should be read as plural and vice versa and masculine as feminine and vice versa, where appropriate, and alternative embodiments do not necessarily imply that the two are mutually exclusive.

The present invention should not be limited to the particular methodology, compounds, materials, manufacturing techniques, uses, and applications, described herein, as these may vary. The terminology used herein is used for the purpose of describing particular embodiments only, and is not intended to limit the scope of the present invention. As used herein and in the appended claims, the singular forms "a," "an," and "the" include the plural reference unless the context clearly dictates otherwise. Thus, for example, a reference to "an element" is a reference to one or more elements and includes equivalents thereof known to those skilled in the art. Similarly, for another example, a reference to "a step" or "a means" may be a reference to one or more steps or means and may include sub-steps and subservient means.

All conjunctions used herein are to be understood in the most inclusive sense possible. Thus, a group of items linked with the conjunction "and" should not be read as requiring that each and every one of those items be present in the grouping, but rather should be read as "and/or" unless expressly stated otherwise. Similarly, a group of items linked with the conjunction "or" should not be read as requiring mutual exclusivity among that group, but rather should be read as "and/or" unless expressly stated otherwise. Structures described herein are to be understood also to refer to functional equivalents of such structures. Language that may be construed to express approximation should be so understood unless the context clearly dictates otherwise.

Unless otherwise defined, all terms (including technical and scientific terms) are to be given their ordinary and customary meaning to a person of ordinary skill in the art, and are not to be limited to a special or customized meaning unless expressly so defined herein.

Terms and phrases used in this application, and variations thereof, especially in the appended claims, unless otherwise expressly stated, should be construed as open ended as opposed to limiting. As examples of the foregoing, the term "including" should be read to mean "including, without limitation," "including but not limited to," or the like; the term "having" should be interpreted as "having at least"; the term "includes" should be interpreted as "includes but is not limited to"; the term "example" is used to provide exemplary instances of the item in discussion, not an exhaustive or limiting list thereof; and use of terms like "preferably," "preferred," "desired," "desirable," or "exemplary" and words of similar meaning should not be understood as implying that certain features are critical, essential, or even important to the structure or function of the invention, but instead as merely intended to highlight alternative or additional features that may or may not be utilized in a particular embodiment of the invention.

Those skilled in the art will also understand that if a specific number of an introduced claim recitation is intended, such an intent will be explicitly recited in the claim, and in the absence of such recitation no such intent is present. For example, as an aid to understanding, the appended claims may contain usage of the introductory phrases "at least one" and "one or more" to introduce claim recitations; however, the use of such phrases should not be construed to imply that the introduction of a claim recitation by the indefinite articles "a" or "an" limits any particular claim containing such introduced claim recitation to embodiments containing only one such recitation, even when the same claim includes the introductory phrases "one or more" or "at least one" and indefinite articles such as "a" or "an" (e.g., "a" and "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C" is used, in general, such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.).

All numbers expressing dimensions, quantities of ingredients, reaction conditions, and so forth used in the specification are to be understood as being modified in all instances by the term "about" unless expressly stated otherwise. Accordingly, unless indicated to the contrary, the numerical parameters set forth herein are approximations that may vary depending upon the desired properties sought to be obtained.

Referring to FIGS. 1-6, a window treatment device 100 of the present invention will now be discussed. The window treatment device 100 may generally include a main body 110, the elongated rod 120, a secondary body 130, a grommet 140, and a curtain rod 150. The grommet 140 may be removably attached to the main body 110, which may be at least partially enclosed by the curtain rod 150. The elongated rod 120 may pass through at least part of the main body 110 and secondary body 130. Additional connections and components may be provided to facilitate connection of one or more of the aforementioned components.

The components of the window treatment device 100 may be constructed using a variety of materials. For example, the elongated rod 120 and/or grommet 140 may be constructed using metals and/or other strong materials. Additionally, the main body 110, secondary body 130, and/or curtain rod 150 may be constructed using plastics, metals, wood, composites, or other materials that will be appreciated by a skilled artisan after having the benefit of this disclosure. The recitation of materials used in this disclosure is solely intended as examples to clearly illustrate various embodiments of the present invention, and is not intended to limit the window treatment device 100 of the present invention in any way.

The main body 110 will now be discussed. The main body 110 may be provided as a component of the window treatment device 100 that interfaces with additional components of the window treatment device 100. In an embodiment of the present invention, the main body 110 may be configured to receive additional components that facilitate the construction of the window treatment device 100.

An example of the main body 110, according to an embodiment of the present invention, will now be discussed without limitation. This example is being provided to clearly illustrate one embodiment of the main body 110 and is not intended to limit the structure or features of the main body 110 in any way. The main body 110 may include an elongated portion of material that extends between a main body front end 112 and a main body rear end 114. The portion of material may additionally include a top surface of the main body, bottom surface of the main body, main body right side 115, and main body left side 116. In one example, each of the sides and surfaces may be approximately orthogonal to one another. However, skilled artisans will appreciate additional configurations of the main body 110 that may include more or less surfaces and sides, which may be oriented differently.

The main body front end 112 and the main body rear end 114 may have opposing outwardly facing surfaces. The main body front end 112 and/or the main body rear end 114 may have main body flanges 113 extending outwardly from the length of material between the main body front end 112 in the main body rear end 114. The edges of these main body flanges 113 may be at least partially rounded such to fit within a curtain rod 150, which will be discussed in greater detail below. In one example, the main body flanges 113 may include a right main body hole 167 and/or a left main body hole 168.

The top surface of the main body 110 may include one or more slots to receive additional components of the window treatment device 100. For example, the top surface of the main body 110 may include an upper main body receiver slot 119 to receive an upper main body retainer clip 189 or other component. The upper main body retainer clip 189 will be discussed in greater detail below. The top surface of the main body 110 may additionally include one or more main body receiver slot. For example, and without limitation, the top surface of the main body 110 may include a right side main body receiver slot 117 and a left side main body receiver slot 118. The main body receiver slots 117, 118 may be configured to receive main body retainer clips 187, 188. In the example given above, without limitation, the right side main body receiver slot 117 on the top surface of the main body 110 may be configured to receive a right side main body retainer clip 187. Similarly, in this example, the left side main body receiver slot 118 on the top surface of the main body 110 may be configured to receive a left side main body retainer clip 188.

The main body sides 115, 116 may additionally include slots and other features configured to interface with additional components of the window treatment device 100. For example, the main body sides 115, 116 may include side main body receiver slots 116, 117, which may be configured to additionally receive the main body 110 retainer clip. For example, without limitation, the main body right side 115 may include a right side main body receiver slot 117 configured to receive a right side main body retainer clip 187. Additionally, in this example, the main body left side 116 may include a left side main body receiver slot 118 configured to receive a left side main body retainer clip 188. The right side main body retainer clip 187 and/or the left side main body retainer clip 188 may interface with additional components of the window treatment device 100, such as the curtain rod 150, without limitation. Installation of retainer clips will be discussed in greater detail below. The main body sides 115, 116 may include a right and/or left cord retainer slot 185, 186, through which a cord may be inserted and/or passed through as a return back to the point of entry for the cord into a component. A cord retainer member 184 may be located within the interior of another component with cord retainer slots, for example, in the interior of a main body 110 that includes cord retainer slots 185, 186. Skilled artisans will appreciate additional configurations of the main body 110, slots and other features provided by the main body 110, and additional components that may interface with the main body 110 after having the benefit of this disclosure.

The bottom surface of the main body 110 may include a bottom main body hole 111 through which an object may be passed. Examples of an object may include a screw, rivet, pin, or other object that could be fitted within the bottom main body hole 111. As will be discussed in greater detail below, the bottom main body hole 111 may be aligned with a bottom curtain rod hole 151 to facilitate securing the main body 110 within the curtain rod 150. The bottom surface of the main body 110 may additionally include a space of absent material, which may advantageously reduce the amount of raw material required to form the main body 110.

The elongated rod 120 will now be discussed. The elongated rod 120 may be a length of material extending between an elongated rod first end 122 and an elongated rod second end 124. The material may be virtually any material, such as metal, plastic, wood, composites, or other materials that would be appreciated by persons skilled in the art. The elongated rod first end 122 may be shaped compatibly with a secondary body elongated rod receiver slot 162 of the secondary body 130. The elongated rod first end 122 may at least partially pass through the secondary body elongated rod receiver slot 162, allowing the secondary body 130 to be movably positioned about various points of the elongated rod 120. Additionally, the elongated rod second end 124 may be shaped compatibly with a main body elongated rod receiver slot 164 of the main body 110, allowing the main body 110 to at least partially receive the elongated rod first end 122.

The rod may be configured in various shapes, sizes, orientations, and other attributes that would be apparent to a person of skill in the art after having the benefit of this disclosure. In one example, provided without limitation, the elongated rod 120 may be configured in a T-shape. In this embodiment, the elongated rod 120 may be substantially straight having a top portion and a bottom portion. The top portion of the elongated rod 120 may have a substantially flat and smooth top surface. The bottom portion of the elongated rod 120 may extend downwardly from about the center of the bottom surface of the top portion of the elongated rod 120. The bottom portion of the elongated rod 120 may abut the top portion of the elongated rod 120 and extend downwardly approximately orthogonally. The main body elongated rod receiver slot 164 in the secondary elongated rod receiver slot may be similarly shaped and/or sized such to receive at least part of the elongated rod 120. Skilled artisans will appreciate additional shapes for the elongated rod 120 and corresponding receiver slots, such as flat, round, hexagonal, square, star, triangular, and other shapes.

The secondary body 130 will now be discussed. The secondary body 130 may provide a body to receive at least part of the elongated rod 120 and be slidably locatable to various positions about the elongated rod 120. The secondary body 130 may include a secondary body front surface 132 and a secondary body rear surface 134. The secondary body front surface 132 may include on its face the secondary body elongated rod receiver slot 162, which may extend through the secondary body 130 providing an exit for the secondary body elongated rod receiver slot 162 on the secondary body rear surface 134. Skilled artisans will appreciate that, in some embodiments, the secondary body 130 is reversible such that the elongated rod 120 may be received by the secondary body elongated rod receiver slot 162 on either the secondary body front surface 132 or the secondary body rear surface 134.

The secondary body 130 may additionally include an upper secondary body receiver slot 133. An upper secondary body retainer clip 139 may be removably inserted into the secondary body 130 via insertion into the upper secondary body receiver slot 133. Additional components may be positioned about the window treatment device 100 using the secondary body 130 as being at least partially secured to the secondary body 130 via the upper secondary body retainer clip 139 received by the upper secondary body receiver slot 133. In one example, without limitation, a grommet may be inserted into the upper secondary body retainer clip 139, both of which may then be inserted into the upper secondary body receiver slot 133. Grommets and their connective structures and features will be discussed in greater detail below.

The secondary body 130 may include additional structures and features on a secondary body right side 135 and secondary body left side 136. For example, the secondary body 130 may include secondary body flanges 138 extending outwardly from the secondary body right side 135 and/or secondary body left side 136. A right secondary body hole 165 may be included by a secondary body flange 138 extending outwardly from the secondary body right side 135. Similarly, a left secondary body hole 166 may be included by a secondary body flange 138 extending outwardly from the secondary body left side 136. Additional objects may be removably secured to the secondary body 130 via the right secondary body hole 165 and/or left secondary body hole 166.

In an additional embodiment, the secondary body 130 may include casters and related components. For example, the secondary body right side 135 may include a right secondary body caster hole 171. Additionally, in this example, the secondary body left side 136 may include a left secondary body caster hole 172. Casters may include additional connective structures that may be passed through their respective caster holes. For example, a right caster 175 may be attached to a right caster axle 173 that can be passed through the right secondary body caster hole 171. Additionally, a left caster 176 may be attached to a left caster axle 174 that can be passed through the left secondary body caster hole 172. The right caster 175 and/or left caster 176 may advantageously increase the structural properties of the secondary body 130 and/or external components that may be attached to the secondary body 130.

The grommet 140 will now be discussed. The grommet 140 may be a piece of material that substantially encircles or surrounds the other components of the window treatment device 100. In one embodiment, the grommet 140 may be a substantially circular ring of material with a central grommet hole 146 that is absent of material. In another embodiment, the grommet 140 may be non-circular, and may be shaped as a square, rectangle, triangle, oval, or other shape that would be appreciated by a skilled artisan after having the benefit of this disclosure. The grommet tab 142 may extend inwardly from the grommet ring 144 into the grommet hole 146 to facilitate attachment of the grommet 140 to additional components of the window treatment device 100. The grommet 140, including the grommet ring 144 and grommet tab 142, may be constructed using a variety of materials, for example, metal, plastic, wood, composites, and virtually any other material as would be appreciated by persons skilled in the art.

The grommet 140 may be removably attached to other components of the window treatment device 100. In one embodiment, the grommet tab 142 may be inserted into a retainer clip that may be received by an additional component of the window treatment device 100. For example, the grommet tab 142 may be inserted into and received by the upper main body retainer clip 189. The grommet 140 may then be removably attached to the main body 110 via inserting the upper main body retainer clip 189 into the upper main body receiver slot 119 of the main body 110. In another example, the grommet tab 142 may be inserted into and received by the upper secondary body retainer clip 139. The grommet 140 may then be removably attached to the secondary body 130 via inserting the upper secondary body retainer clip 139 into the upper secondary body receiver slot 133 of the secondary body 130. Skilled artisans will appreciate additional locations to which the grommet 140 may be attached after having the benefit of this disclosure.

The curtain rod 150 will now be discussed. The curtain rod 150 may include a piece of material configured to at least partially surround another component of the window treatment device 100. For example, the curtain rod 150 may include an approximately cylindrical length of material configured to at least partially surround the main body 110 of the window treatment device 100. Similar to the other components of the window treatment device 100, the curtain rod 150 may be constructed using virtually any material, including, for example, metal, plastic, wood, composites, and/or other materials.

In one illustrative embodiment, the curtain rod 150 may be constructed using a substantially cylindrical length of material extending between the curtain rod front end 152 and the curtain rod rear end 154. The curtain rod 150 may be substantially hollow in its interior and provide a curtain rod inner surface 156 pointing inwardly from the approximately cylindrical body of the curtain rod 150. The curtain rod 150 may also provide a curtain rod outer surface 158 pointing outwardly from the approximately cylindrical body of the curtain rod 150. The body of the curtain rod 150 may include a curtain rod opening 153 through which an object, such as a grommet, retainer clip, or other object may pass. Additionally, the curtain rod 150 may include a curtain rod slot 159 to receive compatible components, such as the right side main body retainer clip 187 and/or left side main body retainer clip 188, which are removably attachable to the main body 110. The curtain rod 150 may include a bottom curtain rod hole 151, which may facilitate attachment of the curtain rod 150 to additional components of the window treatment device 100, such as the main body 110.

Construction of a window treatment device will now be discussed. The components of the window treatment device discussed above may be substantially constructed to create the window treatment device. An illustrative operation to construct a window treatment device, such as the window treatment device 100 illustrated in FIGS. 1-6, will now be discussed without limitation Skilled artisans will appreciate that the components of the window treatment device may be constructed using alternative techniques and that steps involved with construction may be performed in a different order than provided by this example Skilled artisan should not view this illustrative construction process to limit the present invention in any way.

In this illustrative method of constructing a window treatment device, various components may be combined to create the device of the present invention. For example, a window treatment device may be constructed by assembling the main body 110, elongated rod 120, secondary body 130, curtain rod 150, and grommet 140.

Construction may optionally begin by installing a caster in the secondary body. For example, the caster may be attached to a caster axle, which may then be at least partially inserted into a caster hole of the secondary body 130. As a specific example, without limitation, the right caster 175 may be attached to a right caster axle 173 to be inserted into a right secondary body caster hole 171 of the secondary body 130. Additionally, the left caster 176 may be attached to a left caster axle 174 to be inserted into a left secondary body caster hole 172 of the secondary body 130.

The elongated rod first end 122 of the elongated rod 120 may be at least partially inserted into the secondary body elongated rod receiver slot 162. The elongated rod first end 122 of the elongated rod 120 may optionally be passed through the secondary body 130, extending outwardly from the secondary body elongated rod receiver slot 162 on both the secondary body front surface 132 and secondary body rear surface 134. The secondary body 130 may be movable about the elongated rod 120.

The elongated rod second end 124 of the elongated rod 120 may be at least partially inserted into the main body elongated rod receiver slot 164. The elongated rod second end 124 of the elongated rod 120 may optionally be inserted into the main body 110 to a fixed depth, substantially securing the elongated rod second end 124 within the main body 110.

The upper secondary body retainer clip 139 may be inserted into the upper secondary body receiver slot 133 of the secondary body 130. Optionally, additional components may be received by the upper secondary body retainer clip 139 prior to insertion of the upper secondary body retainer clip 139 into the upper secondary body receiver slot 133. For example, a grommet, which may be in addition to the grommet 140 attachable to the main body 110, may be received by the upper secondary body retainer clip 139 and substantially secured to the secondary body 130 via insertion of the upper secondary body retainer clip 139 into the upper secondary body receiver slot 133. Skilled artisans will appreciate that insertion of the upper secondary body retainer clip 139 into the upper secondary body receiver slot 133 may be performed before or after receiving the elongated rod 120 via the secondary body elongated rod receiver slot 162.

Next, one or more side main body retainer clips may be located within a side main body receiver slot of the main body 110. As a specific example, without limitation, a tab of the right side main body retainer clip 187 may be inserted into the right side main body receiver slot 117 of the main body 110. Additionally, in this example, a tab of the left side main body retainer clip 188 may be inserted into the left side main body receiver slot 118 of the main body 110. A cord may optionally be passed through the left cord retainer slot 185 and/or right cord retainer slot 186.

The side main body retainer clips may include a top tab and a side tab, each of which with corresponding side main body receiver slots. The top tab of a side main body retainer clip may be inserted into a side main body receiver slot on a top surface of the main body 110. With the top tab of the side main body retainer clip inserted into the corresponding main body receiver slot on the top surface of the main body 110, the side main body retainer clip may be hingedly moved such that the side tabs of the main body retainer clip be inserted into the side main body receiver slot 116, 117 located on the main body right side 115 and/or main body left side 116. The side main body retainer clip may include additional tabs or protrusions that can be received by the main body 110.

The grommet 140 may be positioned such that the grommet tab 142 is inserted into the upper main body retainer clip 189. The grommet tab 142 may include a raised portion of material that can be received by a recessed portion of material on the upper main body retainer clip 189. After the grommet tab 142 has been inserted into the upper main body retainer clip 189, the upper main body retainer clip 189 may be inserted into the upper main body receiver slot 119.

The main body 110 and additional components now attached to the main body may be moved at least partially within an interior space of the curtain rod 150. The grommet tab 142 and upper main body retainer clip 189 may be oriented such to pass through the curtain rod opening 153 as the main body 110 is moved within the interior space of the curtain rod 150. The right side main body retainer clip 187 and/or the left side main body retainer clip 188 may be substantially adjacent to the curtain rod inner surface 156. The main body 110 may be inserted into the curtain rod 150 such that the right side main body retainer clip 187 and/or left side main body retainer clip 188 are positioned adjacent to the curtain rod slot 159. In one embodiment, the right side main body retainer clip 187 and/or left side main body retainer clip 188 may be received by the curtain rod slot 159 to substantially secure the position of the main body 110 and connected components within the curtain rod 150.

Figure 7:
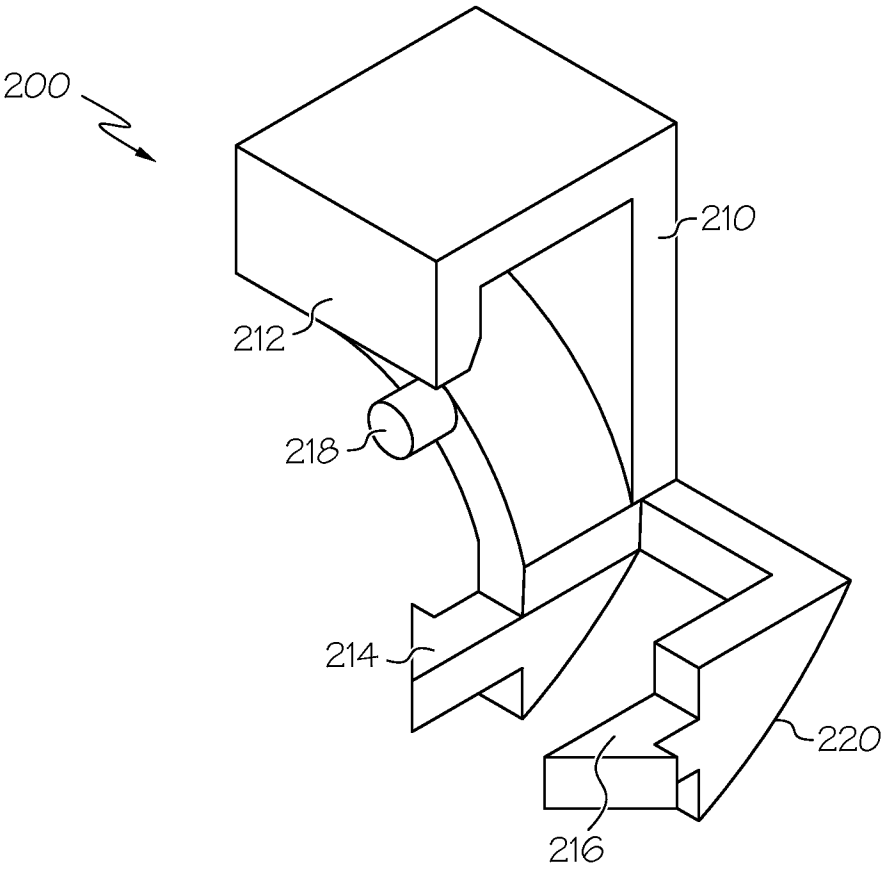
FIG. 7 is a perspective view of a side retainer clip, according to an embodiment of the present invention.

Referring now to FIG. 7, an illustrative side retainer clip 200 will be discussed without limitation. The side retainer clip 200 may attach to a side receiver slot of the main body, such as side retainer slots 117, 118 discussed above. The side retainer clip 200 may include a retainer clip structure 210 to connect the features of the side retainer clip 200 to another component of the window treatment device, such as a main body 110. A retainer clip upper tab may 212 may connect to an upper end of the retainer clip structure 210. In this example, the retainer clip upper tab 212 may be received by a main body receiver slot on the top surface of the main body.

Once the retainer clip upper tab 212 has been received by a receiver slot of the main body, the retainer clip structure 210 and other connected features may be hingedly rotated such that the retainer clip prongs 214, 216 and retainer clip protrusion 218 may be received by retainer slots on the sides of the main body. The retainer clip prongs 214, 216 and retainer clip protrusion 218 may connect to approximately a lower end of the retainer clip structure 210. In one embodiment, the side retainer clip may be removably attached to a side receiver slot of the main body. In an alternative embodiment, the side retainer clip 200 may be substantially fixed to a side receiver slot of the main body, as may be facilitated by prongs 214, 216.

The side retainer clip 200 may additionally include a retainer clip curved edge 220. This retainer clip curved edge 220 may be compatible with a curtain rod slot, for example, the curtain rod slot 159 of curtain rod 150. A main body having a side retainer clip installed, such as the side retainer clip 200 of this example, may be inserted into the curtain rod to a depth such that the retainer clip curved edge is received by the curtain rod slot.

Figure 2:
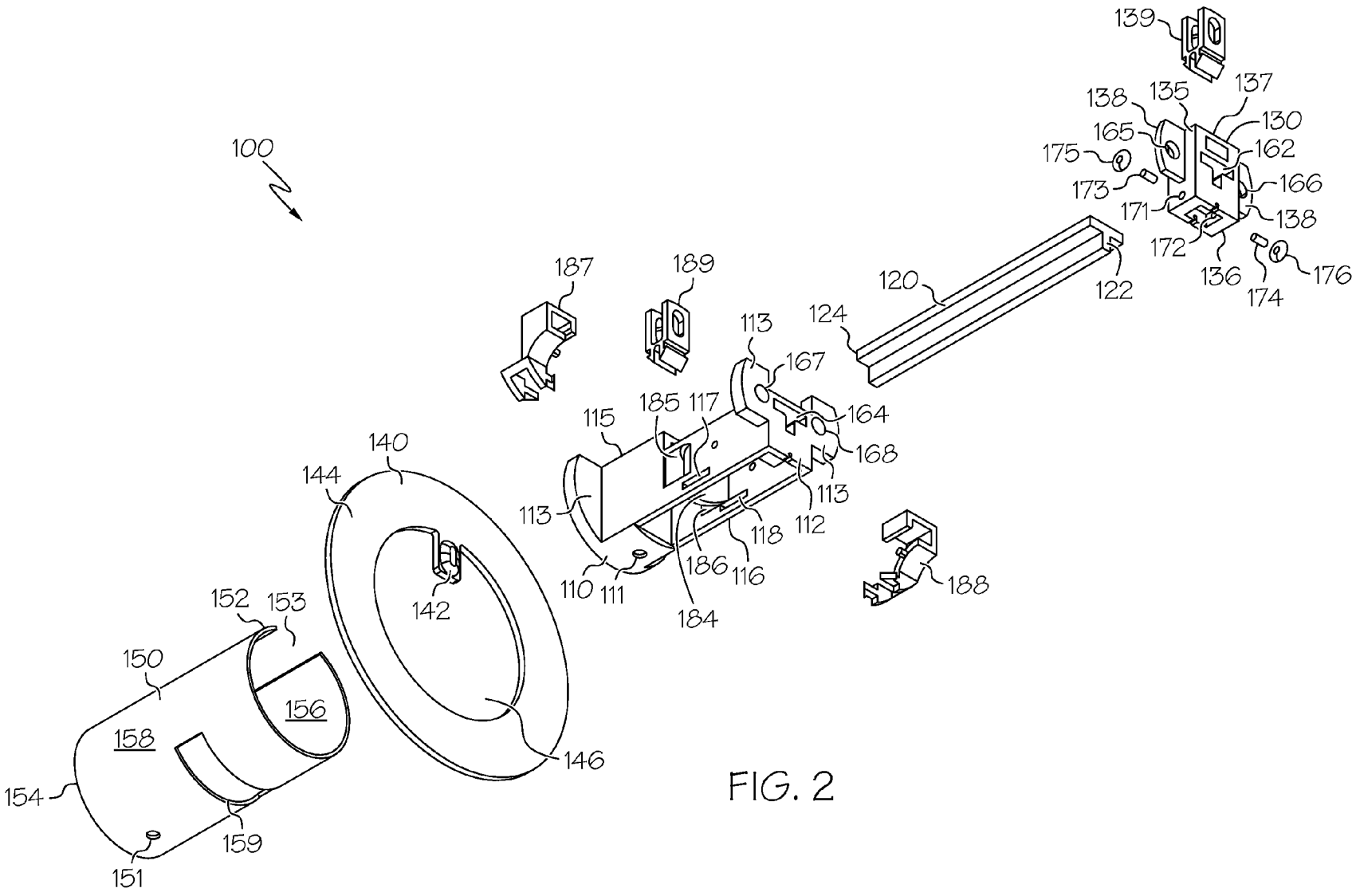
FIG. 2 is an alternative perspective view of the window treatment of FIG. 1
Figure 3:
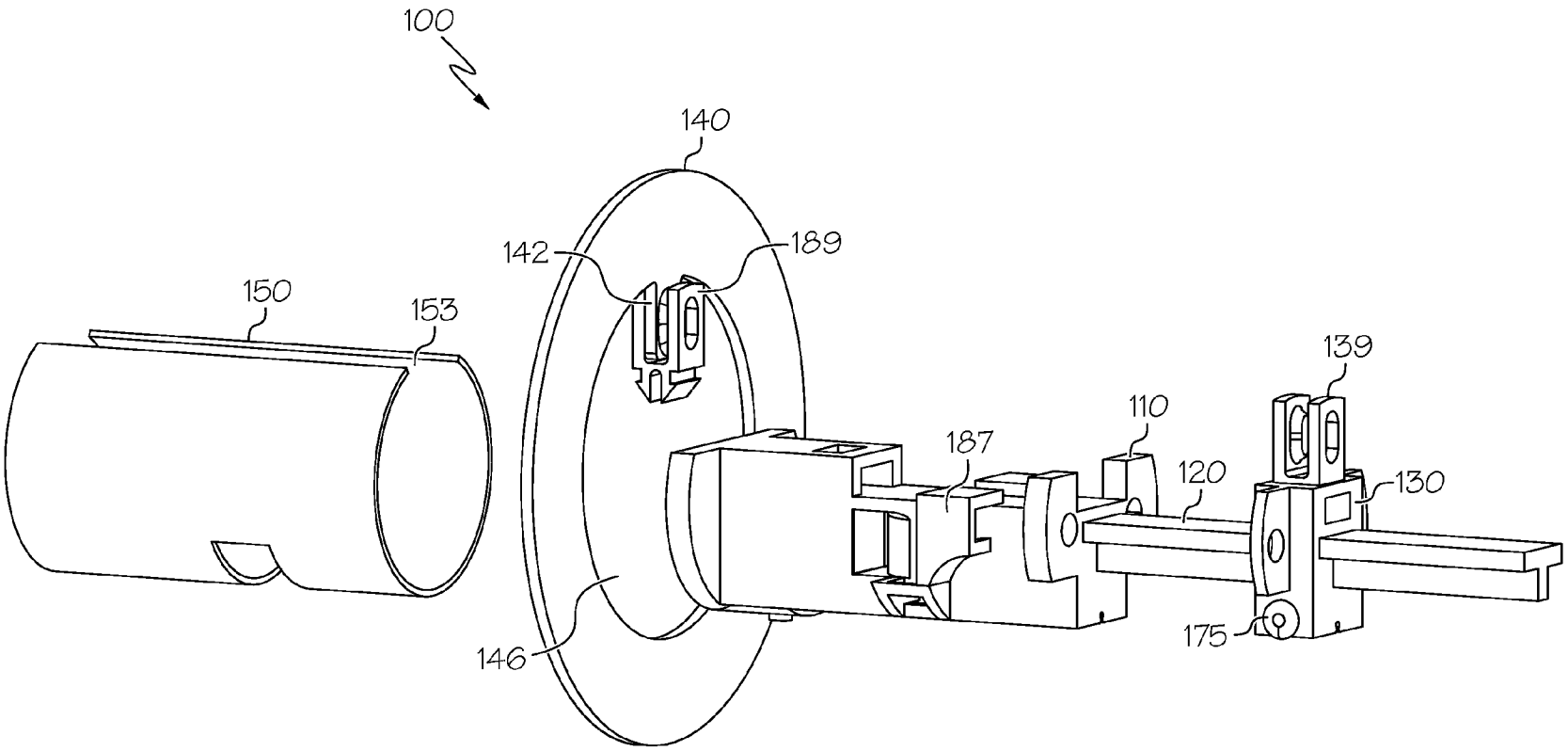
FIG. 3 is a side perspective view of a window treatment during partial construction, according to an embodiment of the present invention.
Figure 4:
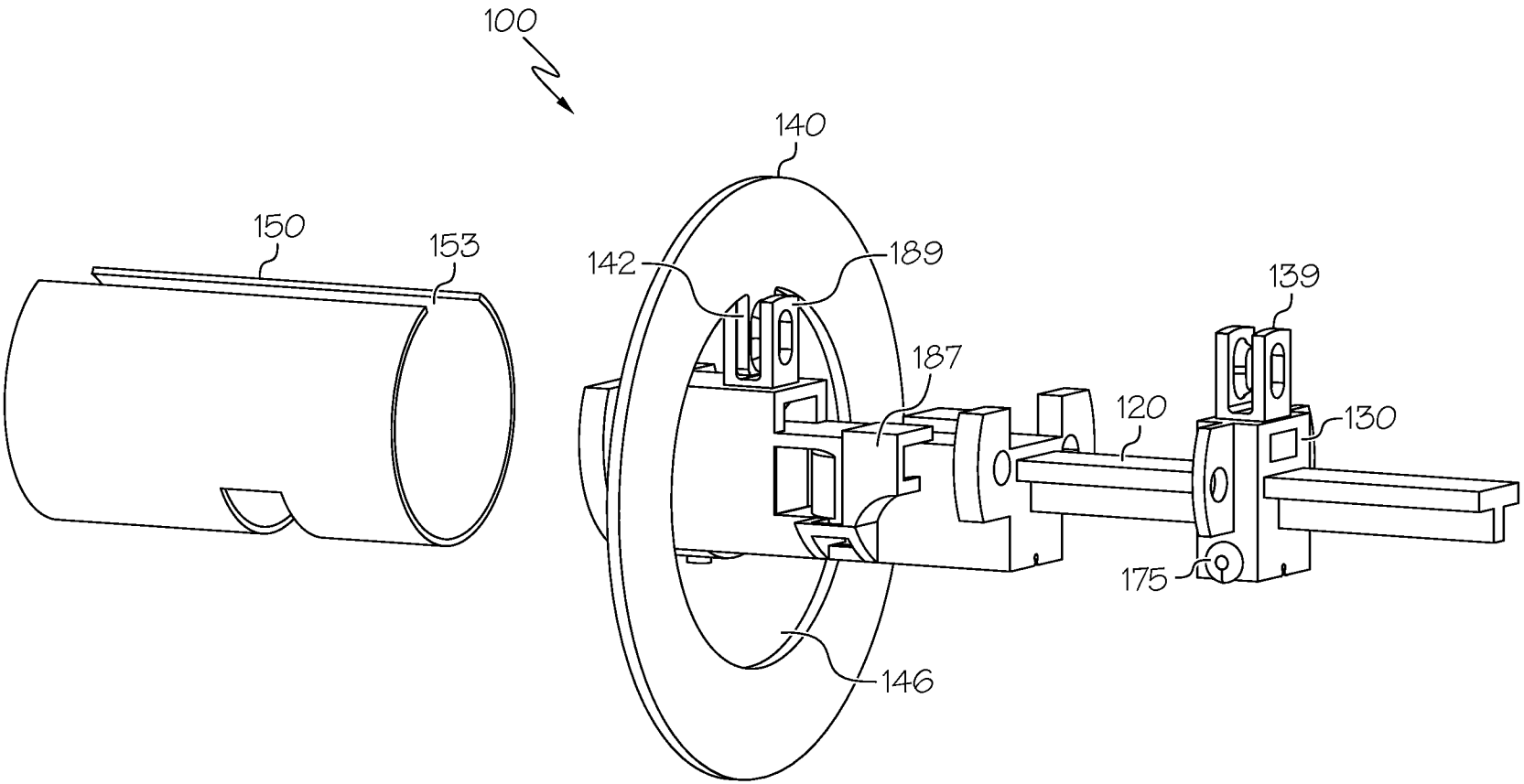
FIG. 4 is a side perspective view of a window treatment during partial construction, according to an embodiment of the present invention.
Figure 5:
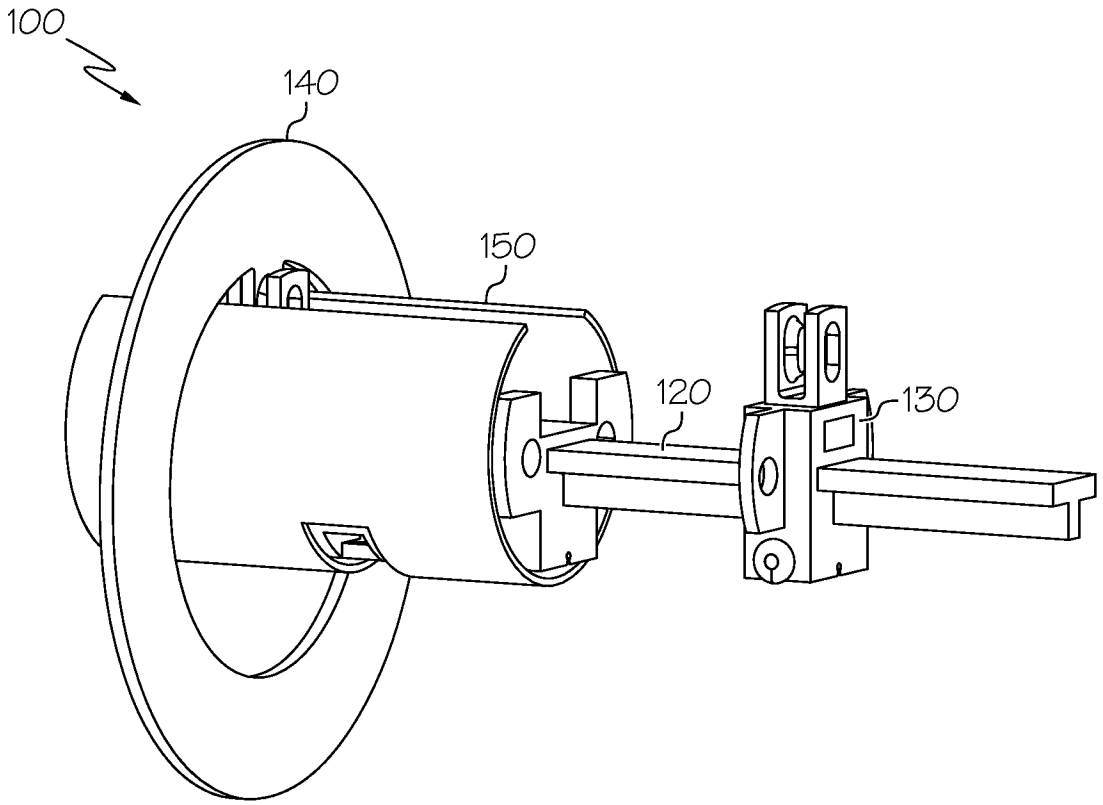
FIG. 5 is a side perspective view of a window treatment being substantially constructed, according to an embodiment of the present invention.
Figure 6:
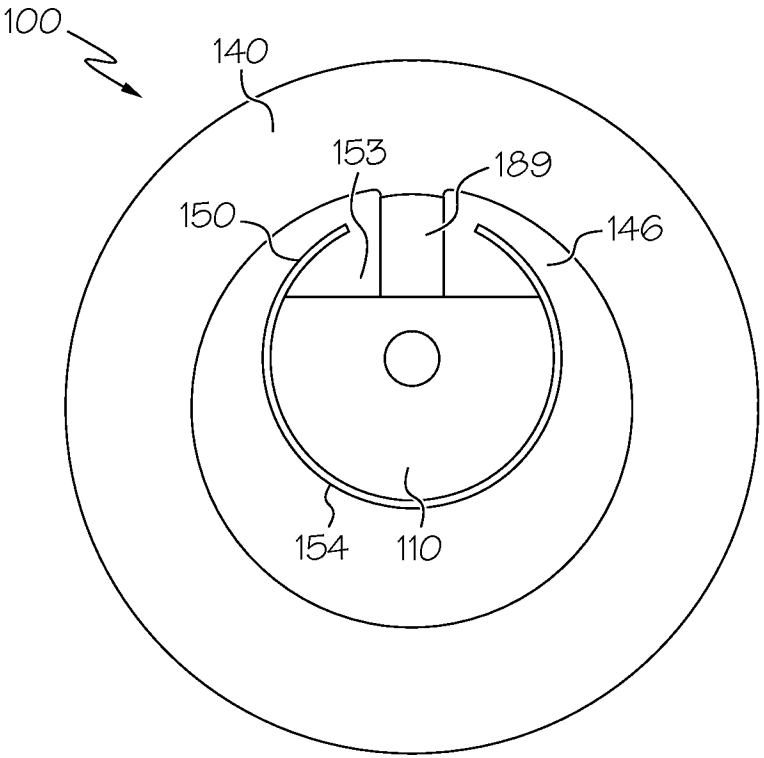
FIG. 6 is a rear elevation view of the window treatment of FIG. 5 being substantially constructed.

Additionally, referring to FIG. 2, the main body 110 may optionally include a bottom main body hole 111 and the curtain rod 150 may optionally include a bottom curtain rod hole 151. The main body 110 may be inserted into the curtain rod 150 such that the bottom curtain rod hole 151 and bottom main body hole 111 are substantially aligned. To enhance the security by which the main body 110 and connected components are attached to the curtain rod 150, an object may be passed through the bottom curtain rod hole 151 and at least partially through the bottom main body hole 111 to maintain alignment of the bottom curtain rod hole 151 and the bottom main body hole 111. This object may be removably fixed within the bottom curtain rod hole 151 and bottom main body hole 111. The object may include a screw, pin, rivet, cotter pin, tab, or other object that would be appreciated by a skilled artisan after having the benefit of this disclosure, without limitation.

OTHER EMBODIMENTS

It is to be understood that while the invention has been described in conjunction with the detailed description thereof, the foregoing description is intended to illustrate and not limit the scope of the invention, which is defined by the scope of the appended claims. Other aspects, advantages, and modifications are within the scope of the following claims.

What is claimed is:

1. A window treatment device comprising a main body;

an elongated rod locatable at least partially within the main body;

a secondary body slidably positionable about the elongated rod;

wherein the secondary body comprises a secondary body caster hole to receive a caster and connected caster axle;

a curtain rod into which the main body is at least partially insertable; and a grommet attachable to the main body.

2. The window treatment device of claim 1, wherein the main body comprises an upper main body receiver slot to attach the grommet.

3. The window treatment device of claim 2, wherein the grommet comprises a grommet tab insertable into an upper main body retainer clip, and wherein the upper main body retainer clip is insertable into the upper main body receiver slot to attach the grommet to the main body.

4. The window treatment device of claim 3, wherein the curtain rod comprises a curtain rod opening extending substantially between a curtain rod front end and a curtain rod rear end of the curtain rod.

5. The window treatment device of claim 4, wherein at least part of the grommet is at least partially passable through the curtain rod opening.

6. The window treatment device of claim 5, wherein the main body that is removably attached to the grommet via insertion of the upper main body retainer clip into the upper main body receiver slot is at least partially passable through the curtain rod opening with the grommet.

7. The window treatment device of claim 1, wherein the main body comprises a side main body receiver slot to removably receive a side main body retainer clip.

8. The window treatment device of claim 1, wherein the main body comprises a main body right side and a main body left side, wherein the main body right side comprises a right side main body receiver slot and the main body left side comprises a left side main body receiver slot, wherein a right side main body retainer clip is removably insertable into the right side main body receiver slot, and wherein a left side main body retainer clip is removably insertable into the left side main body receiver slot.

9. The window treatment device of claim 1, wherein the elongated rod comprises an elongated rod first end and an elongated rod second end, wherein the main body comprises a main body elongated rod receiver slot through which the elongated rod first end is at least partially insertable, and wherein the secondary body comprises a secondary body elongated rod receiver slot through which the elongated rod second end is at least partially insertable.

10. The window treatment device of claim 1, wherein the secondary body comprises a right secondary body caster hole located on a secondary body right side of the secondary body and a left secondary body caster hole located on a secondary body left side of the secondary body, wherein a right caster attached to a right caster axle is at least partially insertable into the right secondary body caster hole, and wherein a left caster attached to a left caster axle is at least partially insertable into the left secondary body caster hole.

11. The window treatment device of claim 1, wherein the elongated rod is substantially T-shaped.

12. The window treatment device of claim 1, wherein the main body comprises a bottom main body hole, where the curtain rod comprises a bottom curtain rod hole, and wherein the curtain rod is removably attachable to the main body by inserting an object through the bottom curtain rod hole and at least partially through the bottom main body hole.

13. A window treatment device comprising:

a main body, further comprising:

an upper main body receiver slot, a right side main body receiver slot on a main body right side of the main body to receive a right side main body retainer clip, a left side main body receiver slot on a main body left side of the main body to receive a left side main body retainer clip, and a main body elongated rod receiver slot;

an elongated rod locatable at least partially within the main body via the main body elongated rod receiver slot;

a curtain rod into which the main body is at least partially insertable, the curtain rod further comprising:

a curtain rod front end, a curtain rod rear end, and a curtain rod opening extending substantially between the curtain rod front end and the curtain rod rear end; and a grommet comprising a grommet tab removably attachable by the main body receiver slot via an upper main body retainer clip;

wherein the grommet is passable at least partially through the curtain rod opening;

wherein the main body is at least partially passable through the curtain rod such to be at least partially enclosed by the curtain rod.

14. The window treatment device of claim 13, further comprising a secondary body slidably positionable about the elongated rod, the secondary body comprising a secondary body elongated rod receiver slot through which the elongated rod is at least partially insertable.

15. The window treatment device of claim 14, wherein the secondary body comprises a secondary body caster hole to receive a caster and connected caster axle.

16. The window treatment device of claim 13, wherein the elongated rod is substantially T-shaped.

17. A method for constructing a window treatment device comprising a main body, an elongated rod, a secondary body, a curtain rod, and a grommet, the method comprising:

(a) locating the elongated rod at least partially within the main body by inserting an elongated rod first end of the elongated rod at least partially into a main body elongated rod receiver slot of the main body;

(b) locating the elongated rod at least partially within the secondary body by inserting an elongated rod second end of the elongated rod at least partially into a secondary body elongated rod receiver slot of the secondary body;

(c) locating a side main body retainer clip within a side main body receiver slot of the main body;

(d) locating a grommet tab of the grommet at least partially within an upper main body retainer clip;

(e) removably inserting the upper main body retainer clip with the grommet tab within an upper main body receiver slot of the main body, passing at least part of the main body through a grommet hole of the grommet; and (f) passing at least part of the main body within the curtain rod such that the curtain rod at least partially encloses the main body;

wherein the second body is movable about the elongated rod.

18. The method of claim 17, wherein before step (a), the method further comprises installing a caster in the secondary body, further comprising:

(i) attaching a caster axle to the caster, and (ii) inserting the caster with the caster axle at least partially into a secondary body caster hole of the secondary body; and wherein after step (a), the method further comprises:

(g) removably inserting an upper secondary body retainer clip into an upper secondary body receiver slot of the secondary body.

19. The method of claim 18, further comprising:

(h) inserting an object through a bottom curtain rod hole of the curtain rod and at least partially through a bottom main body hole of the main body to removably attach the curtain rod to the main body.

* * * * *